United States Patent [19]

Klundt

[11] 4,154,182

[45] May 15, 1979

[54] SEWING MACHINE WITH A COOLING SYSTEM

[75] Inventor: Kurt Klundt, Hirschhorn, Fed. Rep. of Germany

[73] Assignee: Pfaff Industriemaschinen GmbH, Fed. Rep. of Germany

[21] Appl. No.: 867,352

[22] Filed: Jan. 5, 1978

[30] Foreign Application Priority Data

Jan. 13, 1977 [DE] Fed. Rep. of Germany ... 7700784[U]

[51] Int. Cl.[2] ..... D05B 71/00

[52] U.S. Cl. ..... 112/280

[58] Field of Search ..... 112/280, 220; 165/122; 415/219 B

[56] References Cited

U.S. PATENT DOCUMENTS

| | | | |
|---|---|---|---|
| 3,225,824 | 12/1965 | Wartenberg | 165/122 |
| 3,771,478 | 11/1973 | Tranquilla et al. | 112/280 |
| 3,779,188 | 12/1973 | Maroforio | 112/280 |
| 4,062,310 | 12/1977 | Gauch et al. | 112/280 |

*Primary Examiner*—Werner H. Schroeder
*Assistant Examiner*—Andrew M. Falik
*Attorney, Agent, or Firm*—McGlew and Tuttle

[57] ABSTRACT

The sewing machine includes a drive shaft which is rotatably mounted in a housing and is connected to a needle to reciprocate the needle at a stitching area in order to effect sewing of material. A fan blade or impeller is affixed to the main shaft for rotation therewith, and it rotates in a chamber in the housing and is constructed with a central inlet opening to pull in air centrally and to discharge it radially downwardly into a lower extension below the oil pan of the sewing machine. The lower extension includes a plurality of ribs extending downwardly from the bottom wall of the oil pan which forms heat exchanger surfaces over which air from the blower is directed. The heat exchange surfaces are arranged in the form of longitudinally extending ribs which extend substantially parallel to the shaft and they define air flow channels therebetween.

9 Claims, 4 Drawing Figures

SEWING MACHINE WITH A COOLING SYSTEM

FIELD AND BACKGROUND OF THE INVENTION

This invention relates to sewing machines in general and, in particular, to a new and useful sewing machine with a stitch-forming point and a cooling system, comprising a blower, a heat exchanger surface formed by longitudinal ribs running parallel to the main shaft of the machine and a cover plate provided in the area of the ribs to provide air channels for the cooling air flow produced by the blower.

DESCRIPTION OF THE PRIOR ART

In a sewing machine known from the German Disclosure DT-OS No. 22 29 034, open for public inspection on Dec. 28, 1972 and corresponding to U.S. Pat. No. 3,771,478 longitudinal ribs, running parallel to the main shaft of the machine, are disposed on the underside of the oil pan, and perpendicular ribs are disposed on the side surface facing the hand wheel and they jointly form a heat exchanger surface. These ribs are covered by a pan-shape cover, whereby, air channels are formed. An impeller, mounted on the main shaft, produces an air flow which flows through the air channels, cooling the ribs and, hence, the oil in the oil pan. The thus heated air flow discharges into the open at the ends of the air channels facing the stitch-forming point and, therefore, directly above the legs of the machine operator sitting in front of the sewing machine and it is thus unavoidable that at least a portion of the heated air touches the operator's legs and this is annoying to the operator of the machine.

Another sewing machine is known from German Disclosure DT-OS No. 23 31 966, which has been open for public inspection on Jan. 14, 1972 and corresponds to U.S. Pat. No. 3,771,478 and this design also has longitudinal ribs running parallel to the main shaft of the machine and a blower on the underside of the oil pan. The sewing machine sits on a table top, with the distance between it and the longitudinal ribs being kept small enough that the longitudinal ribs and the table top form air channels for the air flow produced by the blower. Again, the air flow discharges into the open at the air channel ends facing the stitch-forming point, but this time, the discharge is above the table top. This prevents the cooling air flow from hitting the operator sitting in front of the machine, however, with this arrangement, it may happen that large workpieces lying on the table top and hanging down from the sewing machine are caused to wave in the air flow, thus, hindering the handling of the workpiece during the sewing operation.

SUMMARY OF THE INVENTION

The present invention provides a sewing machine with a cooling system which avoids the disadvantages mentioned above in relation to the prior art in that, with the invention arrangement, the machine operator is not bothered by the cooling air flow discharging from the air channels, and the operator is not hindered in the handling of the workpieces. The air channels are divided into two groups through which the air flows in opposite directions and whose ends facing the stitch-forming point are flow-technically interconnected by deflection means.

The blower is connected to only one of the two groups of air channels. The cooling air flow produced by the blower flows in the air channels of this group in the direction of the stitch-forming point. After the deflection of the cooling air flow caused by the deflection means, according to the invention, the air then flows in the group of air channels not charged by the blower in the direction of the hand wheel of the sewing machine and finally discharges into the open at the hand wheel end of the sewing machine. If the sewing machine is mounted on a table top, so that the oil pan lies in a cutout of the table top, the discharge openings of the air channels, in contrast to the known sewing machines, are not located directly above, but at a lateral distance from the legs of an operator, seated in the usual working position in front of the sewing machine, so that even a cooling air flow spread out wide after discharging from the air channels, cannot touch the legs of the machine operator.

Since, according to the invention, the cooling air flow is deflected by the deflection means in the direction of the hand wheel and the cooling air discharges from the air channels in this flow direction, it moves even further away from the stitch-forming point after discharging from the air channels, so that, even when the sewing machine is mounted on a through table top, and the oil pan and the air channel discharge openings are located above the table top, it is totally impossible for the cooling air to touch the workpiece being sewn by the sewing machine and thus render the handling thereof more difficult.

According to a further advanced suggestion of the invention, the deflection means are formed by arched ribs extending in an essentially U-shape configuration and interconnecting each two adjacent longitudinal ribs. Since this causes a lesser flow velocity to prevail in the arch-shaped air channels formed by two arched ribs located on the outside due to the greater friction losses than that which prevails in the air channels formed by two arched ribs located on the inside, the arched ribs, according to a further suggestion, are provided with cutouts, making it possible for velocity and pressure differences to equalize in the individual cooling air flows in the various air channels.

A second embodiment of the deflection means, according to the invention, includes a baffle plate, which is disposed so as to be spaced from the ends of the longitudinal ribs facing the stitch-forming point and which serves as a deflection means. To deflect the cooling air flow evenly in the free space between the longitudinal ribs and the baffle plate, and particularly to avoid "dead corners" where the cooling air collects, and stops flowing, the spacing of the ends of the outside longitudinal ribs from the baffle plate is smaller than that of the ends of the inside longitudinal ribs.

This measure of feeding the cooling air flow produced by the blower to only one-half of all of the air channels available and to deflect it to flow through the other air channels, achieves a greater flow velocity of the cooling air in the air channels as compared to the practice exercised heretofore in the known sewing machines of feeding the cooling air flow to all air channels simultaneously. Due to this greater flow velocity, the heat exchange from the longitudinal ribs to the cooling air is more intensive so that better cooling efficiency is achieved at the same air volume per unit of time.

Accordingly, it is an object of the invention to provide an improved sewing machine and a sewing machine cooling system which includes an impeller mounted on a main shaft of the sewing machine which is rotated with the shaft to take air in centrally of the impeller and to discharge it into a passage or compartment formed below the oil pan of the sewing machine and which includes a first passage portion having a plurality of depending heat exchanger ribs therein which extend downwardly from the bottom wall of the oil pan and which define flow channels therebetween for the air and a second passage which is alongside the first passage and which extends from the stitch-forming end of the first passage back toward the impeller for discharge out of the sewing machine housing and which also includes means for deflecting the flow from the first passage to the second passage portion.

A further object of the invention is to provide a sewing machine as well as a cooling system for a sewing machine, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
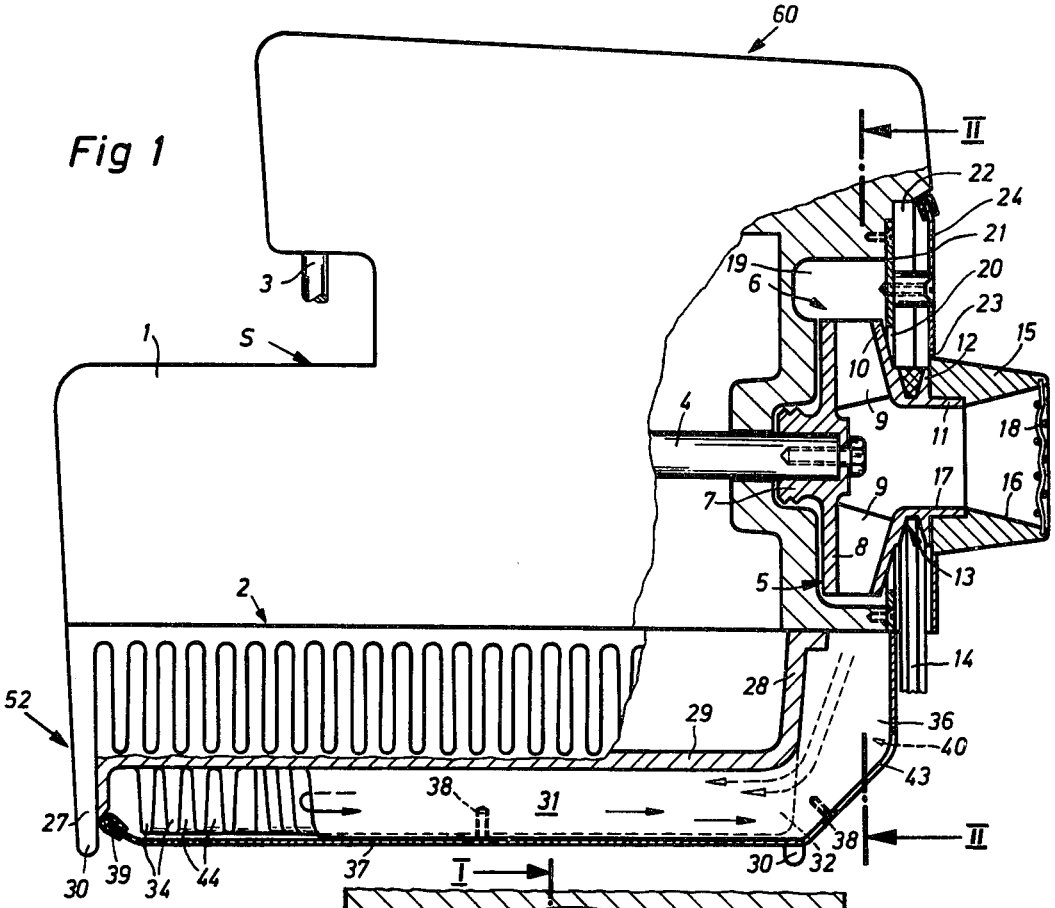
FIG. 1 is a partial elevational and partial sectional view of a sewing machine constructed in accordance with the invention.
Figure 2:
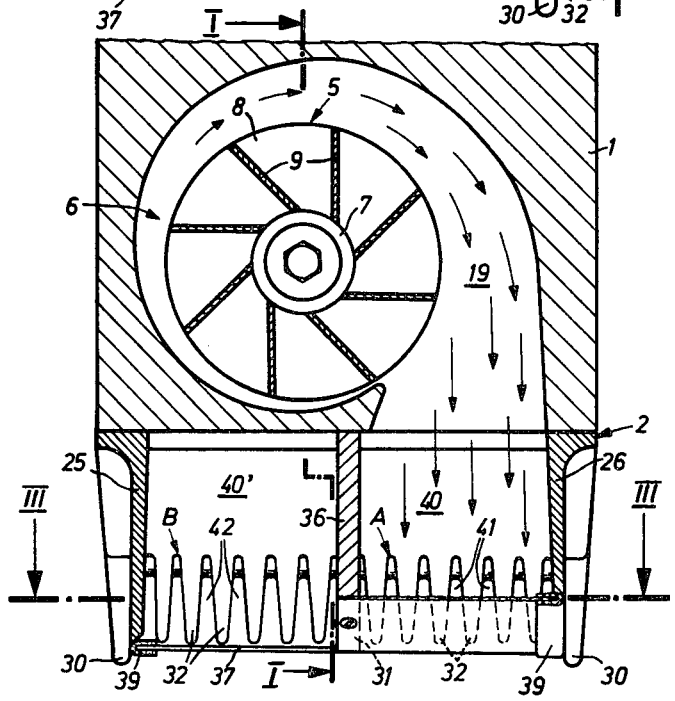
FIG. 2 is a section taken along the line II—II of FIG. 1.
Figure 3:
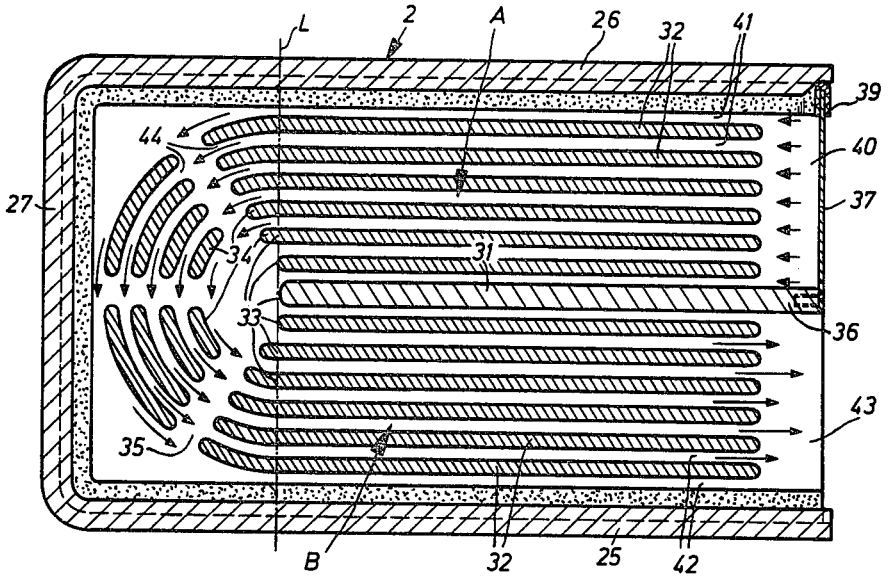
FIG. 3 is a section taken along the line III—III of FIG. 2.

Referring to the drawings in particular, the invention embodied therein in FIGS. 1 to 3, comprises a sewing machine, generally designated 60, which includes its own cooling system, generally designated 52. The cooling system 52 includes an impeller or fan 5 which operates to draw air axially inwardly and to discharge it radially into flow chambers or passages 40 and 40′ for flow in one direction away from the impeller and flow in an opposite direction back toward the impeller and then discharge outwardly through a discharge opening or cutout 43.

The sewing machine 60 has a housing 1 and an oil pan 2. A needle bar 3, shown only partially in FIG. 1, marks the position of the stitch-forming point S of the sewing machine. A main shaft 4 is mounted in housing 1, at the end of which, an impeller 5 of a cooling air blower 6 is fastened. The impeller 5 consists of a hub 7, a through plate 8 connected thereto and several blades 9 which support a ring 10. Further, an annular extension 11 having a likewise annular shoulder 12 is attached to the ring 10. The inner part of ring 10, extension 11 and shoulder 12 form a pulley 13 for a V-belt 14 to drive the main shaft 4.

A hand wheel 15 is fastened to the outer end of the annular extension 11. The impeller 5 and the pulley 13 of the embodiment described are combined into one component part which is produced, for example, by die casting. In order that the air can enter impeller 5 axially without obstruction, hand wheel 15 has a bore 16 tapering down in a funnel-shape configuration, and impeller 5 and pulley 13, respectively, have an essentially cylindrical bore 17. The intake opening of bore 16 is closed by a screen 18.

The impeller 5 is located inside of a helical blower chamber 19, formed in housing, 1, and it is closed towards the outside by a cover plate 21 provided with a cutout 20. The V-belt 14 runs in a cutout 22 in housing 1 and is covered by a belt cover plate 24 having a cutout 23.

Oil pan 2 comprises longitudinal sidewalls 25 and 26, running parallel to the main shaft 4, transverse or end walls 27 and 28, and a bottom 29. The long sidewalls 25 and 26 and the short end wall 27, located in the area of the sewing machine facing the stitch-forming point S, are drawn down far below the bottom 29. Feet 30 are formed at the lower ends of the sidewalls 25 and 26.

Longitudinal ribs are arranged parallel to the main shaft 4 on the underside of the bottom 29 of oil pan 2, with the rib in the middle being marked 31 and the other ribs being designated 32. Starting at the end of oil pan 2 facing the hand wheel 15, the longitudinal ribs 31 and 32 cover about three-fourths of the length of oil pan 2. The ends of the longitudinal ribs 31 and 32 facing the stitch-forming point S are marked with the reference symbol 33. The position of these ends 33 is shown in FIG. 3 by the dashdotted line L. The cooling air deflection means according to the invention are formed by two arched ribs 34 which directly adjoin the ends 33 of respective central and outer longitudinal ribs 31, 32. Two ribs 34, 34 interconnect two longitudinal ribs 32 which are of the same spacing from the center rib 31. The arched ribs 34 are interrupted by several cutouts 35. At its end facing the hand wheel 15, the longitudinal rib 31 in the center continues as a web 36 connected to the short end wall 28 and extending to the underside of housing 1.

Longitudinal ribs 31 and 32 and arched ribs 34 are covered by a cover plate 37 which is bent up at the end of oil pan 2 facing the hand wheel 15 and extends in contact with web 36 to the underside of housing 1. The cover plate 37 is fastened to the longitudinal center strip 31 and to the web 36 by means of two screws 38, and its edges support U-shaped sealing strips 39.

The long sidewall 26, short end wall 28, web 36 and cover plate 37 together form an air chute 40 into which the helical blower chamber 19 empties. The cover plate 37, the longitudinal center rib 31, the longitudinal ribs 32 disposed to its right according to FIG. 2, and the long sidewall 26, jointly form a group A of air channels 41 connected to the air chute 40.

Furthermore, the cover plate 37, the longitudinal center rib 31, the longitudinal ribs 32 disposed to its left, according to FIG. 2, and the long sidewall 25, together form a group B of air channels 42, whose ends facing the hand wheel 15 are opposite a cutout 43 provided in the bent-up part of the cover plate 37 and corresponding essentially to the overall width and height of these air channels 42. In addition, the cover plate 37, together with the arched ribs 34, form arch-shaped air channels 44 interconnecting the air channels 41 and 42.

Figure 4:
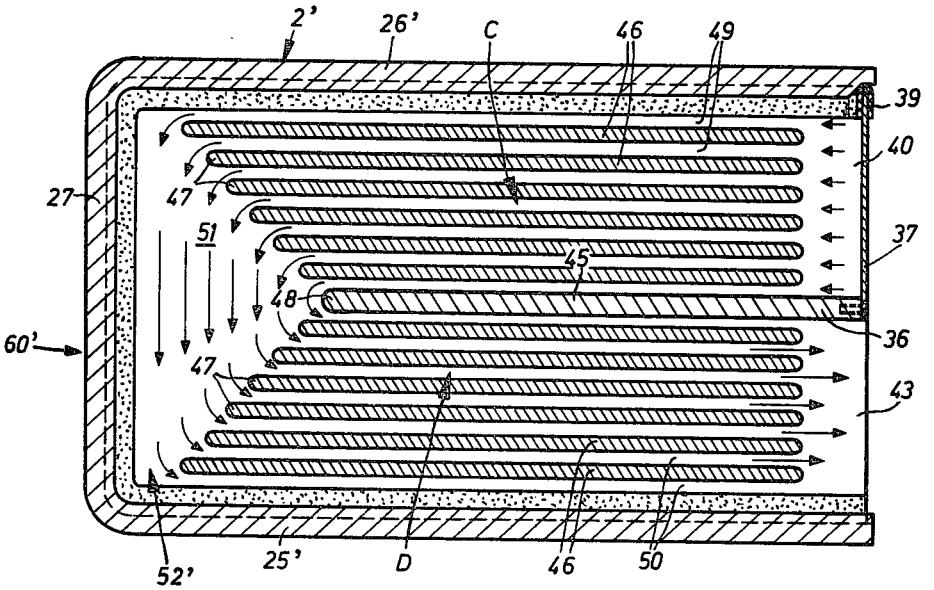
FIG. 4 is a view similar to FIG. 3 of another embodiment of the invention.

In the second embodiment of the invention, as shown in FIG. 4, a sewing machine 60′ includes a cooling system 52′ with a flow system disposed on the underside of bottom 29′ of the oil pan 2′, between the long sidewalls 25′ and 26′ drawn down and the short end wall 27', longitudinal ribs, the central one of which is marked 45, while the others have the reference symbol 46. In this embodiment, a baffle formed by the short end wall 27' of oil pan 2' serves as the cooling air deflection means. The ends 47 of the outer longitudinal ribs 46 facing the short end wall 27 are spaced closer to the short end wall 27 than the ends 47 of the inner longitudinal ribs 46. The end 48 of the longitudinal rib 45 in the center is spaced the furthest apart.

Like the longitudinal ribs 31 and 32 of the first embodiment of the invention, the longitudinal ribs 45 and 46 are covered by the cover plate 37'. Thus, here again, cover plate 37' forms a group C of air channels 49 located on the one side of the longitudinal center rib 45 and connected to the air chute 40' and a group D of air channels 50 located on the other side of the longitudinal center rib 45 and opposite the cutout 43 in the cover plate 37. Furthermore, the cover plate 37, together with the bottom 29, the short sidewall 27 and the ends 47 and 48 of the longitudinal ribs 45 and 46, form a triangular chamber 51.

When the sewing machine is operated, the impeller 5, automatically rotating with the main shaft 4, sucks air from the surrounds of hand wheel 15 through the bores 16 and 17, and pumps it into the blower chamber 19. The cooling air flows from there into the air chute 40. In the first embodiment example, the cooling air then flows into the air channels 41 and then in the direction of the stitch-forming point S. The individual cooling air flows are deflected by 180° in the arch-shaped air channels 44 formed by the arched ribs 34, serving as deflection means, and the flows are then conducted into the air channels 42 in which they then flow back in the direction of the hand wheel 15.

After leaving the air channels 42, the cooling air flow discharges into the atmosphere through the cutout 43 in the cover plate 37. Due to the cutouts 35 in the arched ribs 34, pressure and velocity difference in the individual cooling air flows are enable to equalize in the arch-shaped air channels 44 so that essentially the same flow velocity prevails in the straight air channels as well as the curved air channels, provided that the cross-sectional area of the air channels 41 and 42, and 44 is the same.

In the second embodiment example, the cooling air flows from the air chute 40 into the air channels 49, is also deflected by 180° inside of the chamber 51 by the short end wall 27' of the oil pan 2' serving as the deflection means, and then flows into the air channels 50 and inside them in the direction of the hand wheel 15. After leaving the air channels 50, the cooling air flow discharges into the open through the cutout 43 in cover plate 37 in the second embodiment example also. Uniform deflection of the cooling air and, hence, effective cooling action in the area of the chamber 51 is achieved by constantly reducing, from the inner to the outer longitudinal ribs 45 and 46, the spacing between their ends 47 and 48 and the short end wall 27.

While specific embodiments of the invention have been shown and described in detail to illustrate the application of the principles of the invention, it will be understood that the invention may be embodied otherwise without departing from such principles.

What is claimed is:

1. In a sewing machine, including a housing, a drive shaft rotatably mounted in said housing, a needle bar mounted in said housing and connected to said drive shaft for reciprocation thereby to effect stitching at a stitch area in alignment with said needle on said housing, the improvement comprising, an air impeller connected to the shaft for rotation thereby, means defining an impeller chamber in said housing in which said impeller is rotatable, a heat exchanger defined in said housing having first and second side-by-side flow passages, a plurality of longitudinally extending ribs in each of said first and second flow passages defining heat exchanger surfaces and longitudinally extending air flow channels between said ribs in each of said air flow passages, said first air flow passage having one end connected to said impeller chamber to receive the discharge of air from said impeller, and having an opposite end, said second passage having one end connected to said opposite end of said flow passage and having an opposite end extending toward said impeller terminating in an air discharge, and deflection means between said first and second passages for deflecting air circulated to said first passage by said blower in a uniform flow into said second passage.

2. In a sewing machine, the improvement claimed in claim 1, wherein said deflection means comprises curved ribs extending in a curve from the respective longitudinal ribs of said first passage to the longitudinal ribs of said second passage.

3. In a sewing machine, the improvement claimed in claim 2, wherein said curved ribs are provided with cutouts intermediate their lengths.

4. In a sewing machine, the improvement claimed in claim 1, wherein said deflection means comprises the end of said first and second passages.

5. In a sewing machine, the improvement claimed in claim 4, wherein said deflection means comprises an end wall of said first and second passages, each of said ribs of said first and second passages being of progressively longer longitudinal length proceeding in a direction away from the respective other passage.

6. In a sewing machine, the improvement claimed in claim 1, wherein said air impeller includes a plurality of radially extending blades defining radial flow passages therebetween and having a central inlet portion, a groove defined around the periphery of said impeller adjacent the central inlet portion forming a drive belt receiving groove and a hand wheel affixed to said central portion.

7. In a sewing machine, the improvement claimed in claim 6, wherein said hand wheel includes a central open portion aligned with the inlet opening of said central portion of said impeller for the inflow of air thereto.

8. In a sewing machine, the improvement claimed in claim 1, wherein said impeller includes a cylindrical hub portion having an opening therein for the reception of the main shaft and having a central axially extending tubular portion defining an air inlet, and a handle portion formed over the exterior of said central tubular portion.

9. A method of distributing cooling fluid in a sewing machine having a rotatable main shaft rotatably mounted in a housing having an oil pan adjacent its bottom and with a heat exchange compartment formed below the oil pan, comprising, taking the air in axially from one end of the sewing machine, directing it downwardly to the compartment below the oil pan so as to form a heat exchange cooling with the air adjacent to the oil pan, then deflecting the air backwardly in another stream parallel to, and alongside of, the first stream in a direction toward the intake and discharging it in the vicinity of the intake.

* * * * *